US005384224A

United States Patent [19]

Tanikawa et al.

[11] Patent Number: 5,384,224

[45] Date of Patent: Jan. 24, 1995

[54] TONER FOR DEVELOPING ELECTROSTATIC IMAGE

[75] Inventors: Hirohide Tanikawa; Hiroaki Kawakami; Masatsugu Fujiwara, all of Yokohama; masashi Jinbo, Asaka; Tsutomu Onuma, Kawasaki, all of Japan

[73] Assignee: Canon Kabushiki Kaisha, Tokyo, Japan

[21] Appl. No.: 26,002

[22] Filed: Mar. 4, 1993

[30] Foreign Application Priority Data

Mar. 6, 1992 [JP] Japan ..... 4-082930

[51] Int. Cl.[6] ..... G03G 9/087

[52] U.S. Cl. ..... 430/106; 430/110

[58] Field of Search ..... 430/106, 110, 109, 111

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/104 |
| 4,737,432 | 4/1988 | Tanaka et al. | 430/110 |
| 4,952,476 | 8/1990 | Sakashita et al. | 430/106.6 |
| 5,110,704 | 5/1992 | Inoue et al. | 430/110 |
| 5,135,833 | 8/1992 | Matsunaga et al. | 430/110 |
| 5,169,738 | 12/1992 | Tanikawa et al. | 430/106.6 |
| 5,225,303 | 7/1993 | Tomita et al. | 430/110 |
| 5,229,242 | 7/1993 | Mahabadi et al. | 430/110 |

FOREIGN PATENT DOCUMENTS

| | | |
|---|---|---|
| 52-3304 | 1/1977 | Japan . |
| 52-3305 | 1/1977 | Japan . |
| 57-52574 | 9/1982 | Japan . |
| 60-217366 | 10/1985 | Japan . |
| 60-252360 | 12/1985 | Japan . |
| 60-252361 | 12/1985 | Japan . |
| 61-94062 | 5/1986 | Japan . |
| 61-138259 | 6/1986 | Japan . |
| 61-273554 | 12/1986 | Japan . |
| 62-14166 | 1/1987 | Japan . |
| 1-109359 | 4/1989 | Japan . |
| 2-79860 | 3/1990 | Japan . |
| 3-50559 | 3/1991 | Japan . |

*Primary Examiner*—John Goodrow

*Attorney, Agent, or Firm*—Fitzpatrick, Cella, Harper & Scinto

[57] ABSTRACT

A toner for developing an electrostatic image is constituted by a binder resin and a hydrocarbon wax having a weight-average molecular weight of 800 to 3600. The toner is provided with good fixation characteristics including low-temperature fixability and anti-high temperature offsetting if the toner shows a storage modulus of at least $1\times10^{3}$ *dyn/cm2*, a loss modulus in the range of $5\times10^{2}$–$5\times10^{4}$ dyn/cm$^2$ and a ratio of loss modulus/storage modulus (loss tangent) of below 0.9 as measured under conditions of a frequency of 0.1 Hz and a temperature of 200° C.; and the toner provides a DSC curve, as measured by a differential scanning calorimeter, showing an onset temperature of heat absorption of at most 105° C. and a heat-absorption peak temperature in the range of 90°–120° C. on temperature increase, and a heat evolution peak temperature in the range of 62°–75° C. and a heat evolution peak intensity ratio of at least $2\times10^{-3}$ on temperature decrease.

33 Claims, 2 Drawing Sheets

TONER FOR DEVELOPING ELECTROSTATIC IMAGE

FIELD OF THE INVENTION AND RELATED ART

The present invention relates to a toner for developing electrostatic images used in image forming methods, such as electrophotography electrostatic recording and magnetic recording, suitable for heat fixation.

Hitherto, a large number of electrophotographic processes have been known, inclusive of those disclosed in U.S. Patents Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper, as desired, fixed by heating, pressing, or heating and pressing, or with solvent vapor to obtain a copy. The residual toner on the photosensitive member which is not transferred is cleaned by various methods, and then the above steps are repeated.

In recent years, such an electrophotographic image forming apparatus has been used not only as a copying machine for office work but also as a printer, as an outputting means for a computer and a copier for personal use.

Accordingly, machines of a smaller size, a smaller weight, a higher speed and a higher reliability are being seriously sought. Also desired is a machine composed of simpler members. As a result, a toner is required to exhibit higher performances, and an excellent machine cannot be satisfactorily operated if improved toner performances are not available.

Regarding the step of fixing a toner image onto a sheet such as paper, various methods and apparatus have been developed, inclusive of those based on the heat-fixing system using hot rollers, and the heat-fixing method of pressing a toner image onto a sheet by a heating member by the medium of a film.

In the heat-fixing system using such hot rollers or a film, a sheet carrying a toner image to be fixed (hereinafter called "fixation sheet") is conveyed, while the surface of a hot roller or a film having a releasability with the toner is caused to contact the toner image surface of the fixation sheet under pressure, to fix the toner image. In this method, as the hot roller or film surface and the toner image on the fixation sheet contact each other under pressure, a very good heat efficiency is attained for melt-fixing the toner image onto the fixation sheet to afford quick fixation, so that the method is very effective in a high-speed electrophotographic copying machine. In this method, however, a toner image in a melted state is caused to contact a hot roller or film surface under pressure, so that there is observed a so-called offset phenomenon in which a part of the toner image is attached and transferred to the hot roller or film surface and then transferred back to the fixation sheet to stain the fixation sheet. It has been regarded as one of the important conditions in the heat-fixing system to prevent the toner from sticking to the hot roller or film surface.

In order to prevent a toner from sticking onto a fixing roller surface, it has been conventionally practiced to manufacture the roller surface of a material showing excellent releasability against the toner, (e.g., silicone rubber or fluorine-containing resin) and further coating the surface with a film of a liquid showing a good releasability, such as silicone oil, so as to prevent the offset and fatigue of the roller surface. This method is very effective for preventing offset but requires a device for supplying such an offset preventing liquid, thus making the fixing apparatus complicated.

Further, the use of such an offset preventing liquid is contrary to the demand for a smaller and lighter apparatus and can sometimes soil the inside of the apparatus due to vaporization of the offset preventing liquid, such as silicone oil. Therefore, based on a concept of supplying an offset-preventing liquid from inside toner particles under heating instead of using a device for supplying silicone oil, there has been proposed to incorporate a release agent, such as low-molecular weight polyethylene or low-molecular weight polypropylene. Addition of such a release agent in an amount exhibiting a sufficient effect leads to other practical problems, such as filming onto a photosensitive member, soiling of the surface of a carrier or a toner-carrying member, such as a sleeve, and deterioration of developed images. Accordingly, there has been adopted a combination of adding a release agent in an amount small enough to avoid deterioration of developed images into toner particles and supplying a small amount of a release oil or using a cleaning device including a web used little by little which is wound up to remove offset toner.

However, in view of recent demands for a smaller, lighter and more reliable apparatus, it is desired to remove even such an auxiliary device. This cannot be complied with, unless the toner performances, such as fixability and anti-offset characteristic, are further improved. Thus, it is difficult to provide such an excellent toner without further improvement of a binder resin and a release agent in a toner.

The addition of waxes as a release agent in toner particles is known, as disclosed in, e.g., Japanese Laid-Open Patent Application (JP-A) 52-3304, JP-A 52-3305, JP-A 57-52574, JP-A H3-50559, JP-A H2-79860, JP-A H1-109359, JP-A 62-14166, JP-A 61-273554, JP-A 61-94062, JP-A 61-138259, JP-A 60-252361, JP-A 60-252360, and JP-A 60-217366.

Waxes have been used to provide a toner improved in anti-offset characteristic at low or high temperature and fixability at a low temperature.

However, it is difficult to disperse waxes in a binder resin, and various conditions have been improved on melt-kneading therefor. As a result, there have been several cases of failing to fully exhibit the performances of the binder resin and the wax used. Further, as a wax showing a better performance is liable to be not readily dispersed in a binder resin, it is difficult to fully utilize the property of the binder resin.

SUMMARY OF THE INVENTION

An object of the present invention is to provide a toner having solved the above-mentioned problems and showing excellent effect through full exhibition of the binder resin properties.

A more specific object of the invention is to provide a toner excellent in fixability and anti-offset characteristic at low temperatures of a heating member.

Another object of the invention is to provide a toner excellent in fixability and anti-offset characteristic at high temperatures.

Another object of the invention is to provide a toner excellent in anti-blocking characteristic and free from deterioration in developing performance even when left standing for a long period.

Another object of the invention is to provide a toner excellent in resistance to a temperature elevation in an apparatus.

According to the present invention, there is provided a toner for developing an electrostatic image, comprising: a binder resin and a hydrocarbon wax having a weight-average molecular weight of 800 to 3600, wherein the toner shows a storage modulus of at least $1\times10^3$ dyn/cm$^2$, a loss modulus in the range of $5\times10^2$–$5\times10^4$ dyn/cm$^2$ and a ratio of loss modulus/storage modulus (loss tangent) of below 0.9 as measured under conditions of a frequency of 0.1 Hz and a temperature of 200° C.; and the toner provides a DSC curve, as measured by a differential scanning calorimeter, showing an onset temperature of heat absorption of at most 105° C. and a heat-absorption peak temperature in the range of 90°–120° C. on temperature increase, and a heat evolution peak temperature in the range of 62°–75° C. and a heat evolution peak intensity ratio of at least $2\times10^{-3}$ on temperature decrease.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
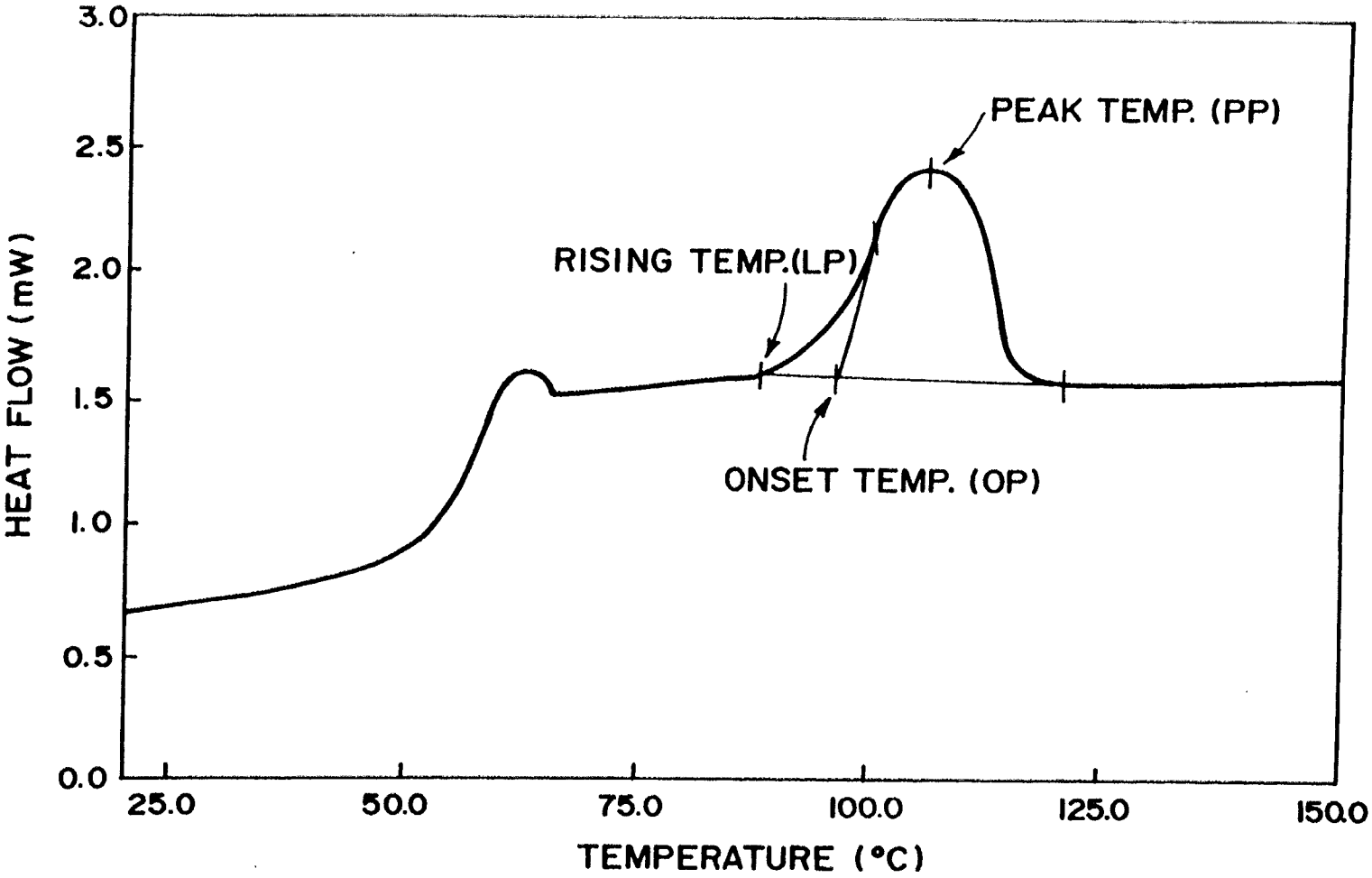
FIG. 1 shows a DSC curve on temperature increase of Toner 1 according to the invention.

The toner according to the present invention is characterized by retaining a storage modulus of at least $1\times10^3$ dyn/cm$^2$ at 0.1 Hz and 200° C. and is excellent in anti-offset characteristic. Below $1\times10^3$ dyn/cm$^2$, the toner when softened lacks a sufficient rubber elasticity, thus being liable to be offset to the fixing roller side or flow out by a fixing roller cleaning member to soil the images.

The storage modulus at 200° C. may preferably be in the range of $2\times10^3$–$5\times10^4$ dyn/cm$^2$, particularly preferably $3\times10^3$–$2\times10^4$ dyn/cm$^2$. If the storage modulus exceeds $5\times10^4$ dyn/cm$^2$, the toner can have too strong a rubber elasticity at high temperatures which may adversely affect the fixability.

In case where the loss modulus is $5\times10^2$–$5\times10^4$ dyn/cm$^2$, preferably $1\times10^3$–$2\times10^4$ dyn/cm$^2$, the above-mentioned anti-offset characteristic is more effectively exhibited. If the loss modulus is below $5\times10^2$ dyn/cm$^2$, the polymer in the toner is caused to have too low a viscosity and can fail to prevent high-temperature offset or toner flowout from the fixing roller cleaning member even if the toner retains a required rubber elasticity by satisfying the above-mentioned storage modulus.

If the loss modulus exceeds $5\times10^4$ dyn/cm$^2$, the toner is liable to be not easily deformed even at high temperatures, thus failing to be sufficiently fixed onto a transfer-receiving material such as paper.

Another characteristic feature of the toner according to the present invention is that it has a loss tangent of below 0.9. This means that the storage modulus is larger than the loss modulus. As a result, the rubber elasticity of the toner effectively functions to prevent the high temperature offset and the flowout from the fixing roller cleaning member.

In case where the storage modulus exceeds $1\times10^3$ dyn/cm$^2$ the offset phenomenon i.e., the attachment of melted toner onto the fixing roller, can be prevented but it becomes difficult to prevent the toner flowout from the fixing device cleaning member when the loss modulus is large. It becomes possible to most effectively prevent the toner flowout and the high temperature offset if the storage modulus is larger than the loss modulus at the measurement frequency (0.1 Hz) at 200° C. As a matter of course, the offset problem is also solved when the toner flowout is prevented.

As the conventional toners have a loss modulus which is larger than or identical to the storage modulus, they have failed to show an elasticity sufficient to fully prevent the high temperature offset and the toner flowout.

By analyzing data obtained by subjecting a toner to differential scanning calorimetry by using a DSC (differential scanning calorimeter), it is possible to know a thermal behavior of a toner. More specifically, from such data, it is possible to know heat transfer to and from a toner and changes in state of the toner. For example, it is possible to know whether or not offset phenomenon can be obviated and what are thermal influences during storage and actual use, inclusive of the anti-blocking characteristic and the effect of heating on the developing performance of the toner.

From a DSC curve on temperature increase, it is possible to observe a state change of a toner under heat application and heat absorption peaks accompanying the transfer, melting or dissolution of the wax component. In the present invention, the toner may preferably show a rising initiation temperature (LP) of heat absorption peak of at least 80° C. so as to show an excellent anti-blocking characteristic. If the temperature is below 80° C., the toner starts to cause a plastic change in a long time range from a relatively low temperature, thus being inferior in storability or causing deterioration of developing performance at an elevated temperature. The toner according to the present invention is characterized by an onset temperature (OP), i.e., a temperature giving an inflection point on a rising part, of a heat absorption peak of at most 105° C., preferably in the range of 90°–102° C., so as to provide an excellent low-temperature fixability. On the other hand, if the onset temperature exceeds 105° C., the temperature causing a plastic change in a short time range becomes high, thus resulting in inferior anti-low-temperature offset characteristic or fixability.

Another characteristic feature of the toner according to the present invention is that it shows a heat-absorption peak temperature in the range of 90°–120° C., preferably 100°–115° C. As a result, the toner can show good fixability and anti-high-temperature offset characteristic. If the temperature is below 90° C., the wax is melted in the binder resin before the toner reaches a high temperature so that it becomes difficult for the toner to show a sufficient anti-offset characteristic at high temperatures. On the other hand, in excess of 120° C., it becomes difficult for the toner to show a sufficient fixability.

A toner binder resin used for heat-fixing enters a viscoelastic region susceptible of fixation from about 100° C. and, if the wax component is melted in the temperature region, the resin is provided with an increased plasticity and an improved fixability, and the release effect is sufficiently exhibited to provide an improved anti-offset characteristic. As a result, paper carrying the toner image after fixation does not adhere to the fixing roller or film, thus not necessitating reliance on a separation claw to be free from traces of the claw. Also the pressing roller is not stained, and winding about the pressing roller is obviated. Provided that the above conditions are satisfied, another peak can be present in another region.

From DSC curves on temperature decrease, it is possible to observe the state at normal temperature and state changes under cooling of a toner, and heat evolution peaks accompanying the solidification or crystallization and other phase transition of the wax component. The toner according to the invention is characterized by having a heat evolution peak temperature in the range of 62°-75° C., preferably 65°-72° C., whereby good fixability and anti-blocking characteristic are ensured. Above 75° C., the temperature range for keeping the wax in a molten state becomes narrow to show inferior fixability. Below 62° C., the toner is liable to cause blocking or sticking, and the plasticity of the binder resin is retained down to a low temperature. As a result, the fixed image can be accompanied with traces of claw at the paper-discharging part and sheets carrying toner images can be attached to each other on the discharge tray.

The toner can further show a heat evolution peak temperature in the region of above 75° C., but it is preferred that the peak in the region of 62°-75° C. is the largest one.

The toner is further characterized by having a peak intensity ratio of at least $2\times10^{-3}$, preferably at least $5\times10^{-3}$, particularly preferably at least $10\times10^{-3}$. A higher peak intensity ratio is related with a wax component having a higher density, a higher crystallinity or a higher hardness, and a toner having less blocking characteristic and excellent triboelectric chargeability. Below $2\times10^{-3}$, the toner is caused to have inferior anti-blocking characteristic and is adversely affected in developing performance, particularly at an elevated temperature. This is particularly pronounced when the peak temperature is lowered. Further, the toner is liable to cause sticking onto the photosensitive member.

The DSC measurement for characterizing the present invention is used to evaluate heat transfer to and from a toner and observe the behavior, and therefore should be performed by using an internal heating input compensation-type differential scanning calorimeter which shows a high accuracy based on the measurement principle. A commercially available example thereof is "DSC-7" (trade name) mfd. by Perkin-Elmer Corp. In this case, it is appropriate to use a sample weight of about 10-15 mg for a toner sample or about 2-5 mg for a wax sample.

The measurement may be performed according to ASTM D3418-82. Before a DSC curve is taken, a sample (toner or wax) is once heated for removing its thermal history and then subjected to cooling (temperature decrease) and heating (temperature increase) respectively at a rate of 10° C./min. in a temperature range of 0° C. to 200° C. for taking DSC curves. The temperatures or parameters characterizing the invention are defined as follows.

1) Regarding a heat absorption peak of a toner (absorbed heat is taken in the positive (or upward) direction):

The rising temperature (LP) is defined as a temperature at which the peak curve clearly separates from the base line, i.e., a temperature at which the differential of a peak curve begins to increase from a steady positive value or a temperature at which the differential of a peak curve turns from a negative to a positive. A specific example is shown in FIG. 1.

The peak temperature (PP) is a temperature at which a maximum peak in the region of 120° C. or below assumes a peak top.

The onset temperature (OP) is a temperature at which a tangential line taken at a point giving the largest differential on a peak giving the peak temperature (PP) intersects the base line. A specific example thereof is also shown in FIG. 1.

2) Regarding a heat evolution peak of a toner (evolved heat is taken in the negative (or downward) direction):

The peak temperature is a temperature at which a maximum peak assumes a peak top.

Figure 2:
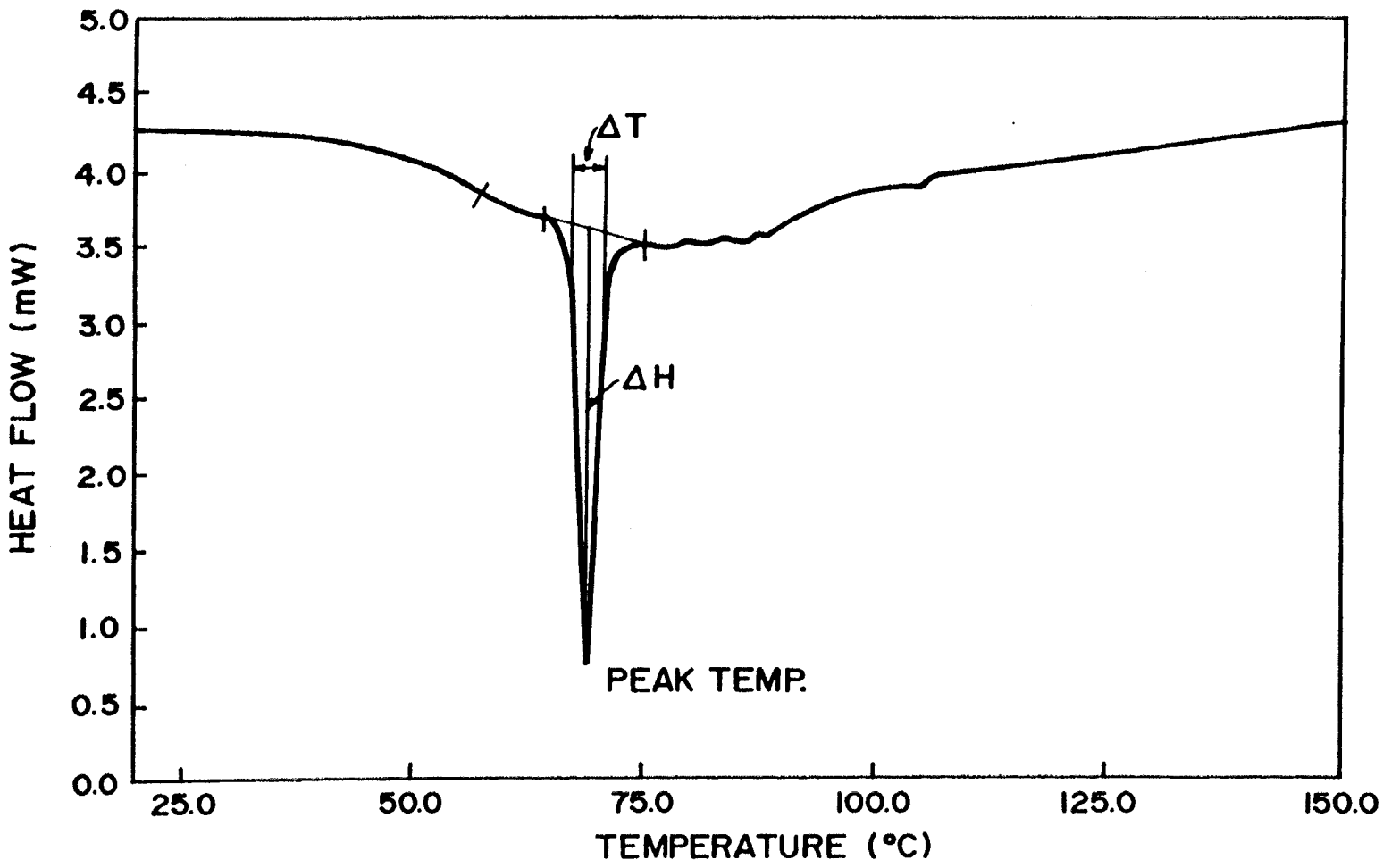
FIG. 2 shows a DSC curve on temperature decrease of Toner 1 according to the invention.

The heat evolution peak intensity ratio is defined by $\Delta H/\Delta T$. For this purpose, two tangential lines are taken at points giving maximum and minimum differentials on the above peak to provide two intersections with the base line. The temperature difference between the two intersections is denoted by $\Delta T$. On the other hand, $\Delta H$ denotes a height of the peak top from the base line per unit weight of the sample in terms of mW/mg and is obtained by dividing a measured peak height on a DSC curve by a sample weight. A specific example thereof is shown in FIG. 2. Accordingly, a higher peak intensity ratio corresponds to a sharper peak if an almost identical weight of sample is used.

The hydrocarbon wax used in the present invention may comprise, e.g., a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a hydrocarbon mixture, distilling the hydrocarbon mixture to recover a residue and extracting a specific fraction having a weight-average molecular weight of 800 to 3600 from the residue. Fractionation of wax may be performed by the press sweating method, the solvent method, vacuum distillation or fractionating crystallization. According to appropriate combination of these fractionation methods for removal of a low-molecular weight fraction, etc., a desired fraction of wax is recovered. It is possible to hydrogenate the hydrocarbon or add an anti-oxidant to the hydrocarbon.

As the source of the hydrocarbon wax, it is preferred to use hydrocarbons having up to several hundred carbon atoms (preferably followed by hydrogenation to obtain an objective product) as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few and small branches. It is further preferred to use hydrocarbon waxes synthesized without polymerization of an alkylene because of their structure and molecular weight distribution suitable for easy fractionation. As for a desired molecular weight distribution, the hydrocarbon wax may preferably have a number-average molecular weight (Mn) of 550–1200, particularly 600–1000; a weight-average molecular weight (Mw) of 900–3000; and an Mw/Mn ratio of at most 3, further preferably at most 2.5, particularly preferably at most 2.0. It is also preferred that the wax shows a peak in a molecular weight region of 700–2400, further 750–2000, particularly 800–1600. By satisfying such molecular weight distribution, the resultant toner is provided with preferable thermal characteristics. If the molecular weights are smaller than the above-described ranges, the toner is excessively affected thermally and is liable to be inferior in anti-blocking characteristic and developing performance. In excess of the above molecular weight ranges, an externally supplied heat .is not utilized effectively so that it becomes difficult to attain excellent fixability and anti-offset characteristic.

As for other properties, the hydrocarbon wax may preferably have a density of at least 0.95 g/cm$^3$, and a penetration of at most $1.5\times10^{-1}$ mm, preferably at most $1.0\times10^{-1}$ mm, respectively at 25° C. Outside these ranges, the properties are changed excessively at low temperatures to provide inferior storability and developing performance.

Further, the wax may have a melt viscosity at 140° C. of at most 100 cP, preferably at most 50 cP, particularly preferably at most 20 cP. If the melt viscosity exceeds 100 cP, the plasticizing effect and release effect are inferior to adversely affect the fixability and anti-offset characteristic. The wax may preferably have a softening point of at most 130° C., particularly at most 120° C. In excess of 130° C., the temperature for exhibiting a particularly effective release effect becomes high and the anti-offset characteristic is adversely affected.

Further, the hydrocarbon wax may preferably have an acid value of below 2.0 mgKOH/g, preferably below 1.0 mgKOH/g. In excess of the range, the wax is caused to have a large interfacial adhesion with the binder resin as another component of the toner to be liable to cause insufficient phase separation under melting, thus being liable to fail in showing good release effect and anti-offset characteristic at high temperatures, and also liable to adversely affect the triboelectric chargeability, developing performance and durability of the resultant toner.

The hydrocarbon wax may be contained in an amount of at most 20 wt. parts, more effectively 0.5–10 wt. parts, per 100 wt. parts of the binder resin.

The molecular weight distribution of hydrocarbon wax may be obtained based on measurement by GPC (gel permeation chromatography), e.g., under the following conditions:

Apparatus: "GPC-150C" (available from Waters Co.)
Column: "GMH-HT" 30 cm-binary (available from Toso K.K.)
Temperature: 135° C.
Solvent: o-dichlorobenzene containing 0.1% of ionol.
Flow rate: 1.0 ml/min.
Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The density and softening point referred to herein are based on measurement according to JIS K6760 and JIS K2207, respectively.

The penetrations of waxes referred to herein are based on measurement according JIS K-2207 whereby a stylus having a conical tip with a diameter of about 1 mm and an apex angle of 9 degrees is caused to penetrate into a sample for 5 sec. under a prescribed weight of 100 g at a sample temperature of 25° C. The measured value is expressed in the unit of 0.1 mm.

The melt viscosity is based on measurement by using a Brookfield-type viscometer by using 10 ml of a sample at a temperature of 140° C. and a shear rate of 1.32 rpm.

The acid value refers to an amount (mg) of potassium hydroxide required for neutralizing the acid group contained in 1 g of a sample and is based on measurement according to JIS K5902.

The hydrocarbon wax may be used in an amount of at most 20 wt. parts, more effectively 0.5–10 wt. parts, per 100 wt. parts of the binder resin, and can be used together with another wax component unless it adversely affects the present invention.

The binder resin constituting the toner according to the present invention may comprise a resin selected from the following class. A part or all of the resin components constituting the binder resin may preferably have a functional group.

Thus, examples of the resin may include: vinyl polymers, polyester resins, epoxy resins, polyamide resins, polyurethane, silicone resins, phenolic resins, polyvinyl butyral, rosin, modified rosin, terpene resins, aliphatic or alicyclic hydrocarbon resins, aromatic petroleum resin, natural resin-modified maleic acid resin, and furan resin. These resins may be used singly or in mixture. Among these, vinyl polymers and polyester resins are particularly preferred.

Examples of the functional group may include: carboxyl group, acid anhydride group, ester group easily susceptible of transesterification, hydroxy group, amino group, glycidyl group, epoxide group, active methylene group, double bond-containing group, cyano group, and isocyanate group. The visco-elasticities characterizing the toner according to the present invention may be obtained by crosslinking between polymer chains during melt-kneading through a reaction forming ester bonds, amide bonds or imide bonds between these functional groups. It is also possible to cause a crosslinking reaction during the melt-kneading by adding a compound, such as acid, alcohol, amine, epoxide, acid anhydride, ketone, aidehyde, amide, ester, lactone or lactam. It is also possible to cause a crosslinking reaction during melt-kneading through a coordinate bond or ionic bond by adding a metal salt, a metal complex or an organometallic compound. A preferred type of crosslinking may include those formed between molecules of binder resins, such as polyester resins or vinyl resins, having an acid group, such as carboxyl group or acid anhydride group by the medium of an organometallic compound, a polyamine or a polyalcohol.

For example, it is possible to provide a vinyl-type binder resin with an acid component by using a carboxylic acid monomer or a carboxylic acid derivative monomer, examples of which may include: unsaturated dibasic acids, such as maleic acid, citraconic acid, dimethylmaleic acid, iraconic acid, alkenylsuccinic acids, fumaric acid, dimethylfumaric acid, alkenylmalonic acid, alkenylglutaric acid, and alkenyladipic acid, and their anhydrides and monoesters; $\alpha,\beta$-unsaturated acids, such as acrylic acid, methacrylic acid, crotonic acid, and cinnamic acid, and bimolecular anhydrides of these $\alpha,\beta$-unsaturated acids, bimolecular anhydrides between two $\alpha,\beta$-unsaturated acids, and bimolecular anhydrides of these $\alpha,\beta$-unsaturated acids, with lower fatty acids.

Among the above, in order to incorporate an acid component in the binder resin used in the present invention, it is particularly preferred to use a monoester of an $\alpha,\beta$-unsaturated dibasic acid having a structure like the one representatively contained in, e.g., maleic acid, fumaric acid and alkenylsuccinic acid. Examples of such monoesters may include: monomethyl maleate, monoethyl maleate, monobutyl maleate, monooctyl maleate, monoallyl maleate, monophenyl maleate, monomethyl fumarate, monoethylfumarate, monobutyl fumarate, monophenyl fumarate, monobutyl n-butenylsuccinate, monomethyl n-octenylsuccinate, monoethyl n-butenylmalonate, monomethyl n-dodecenylglutarate, and monobutyl n-butenyladipate.

In case where the binder resin constituting the toner according to the present invention comprises a vinyl polymer, a vinyl copolymer or a mixture of these, examples of the vinyl monomer providing the binder resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; vinyl halides, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

It is possible to use a crosslinking monomer having two or more polymerizable double bonds as a comonomer for providing the binder resin used in the present invention. Examples thereof are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

The polyester resin used in the present invention may be constituted as follows.

Examples of the dihydric alcohol may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

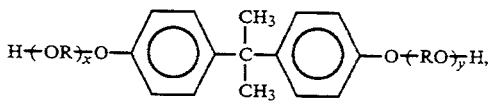

(A)

wherein R denotes an ethylene or propylene group, x and y are independently 0 or a positive integer with the proviso that the average of x+y is in the range of 0–10; and diols represented by the following formula (B):

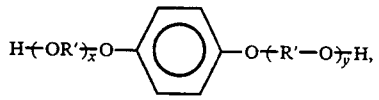

(B)

wherein R′ denotes

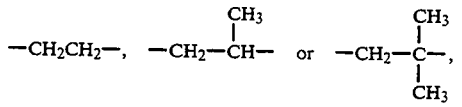

x′ and y′ are independently 0 or a positive integer with the proviso that the average of x′+y′ is in the range of 0–10.

Examples of the dibasic acid may include dicarboxylic acids and derivatives thereof including: benzenedicarboxylic acids, such as phthalic acid, terephthalic acid and isophthalic acid, and their anhydrides or lower alkyl esters; alkyldicarboxylic acids, such as succinic acid, adipic acid, sebacic acid and azelaic acid, and their anhydrides and lower alkyl esters; alkenyl- or alkylsuccinic acid, such as n-dodecenylsuccinic acid and n-dodecyl acid, and their anhydrides and lower alkyl esters; and unsaturated dicarboxylic acids, such as fumaric acid, maleic acid, citraconic acid and itaconic acid, and their anhydrides and lower alkyl esters.

It is preferred to also use polyhydric alcohols having three or more functional groups and polybasic acids having three or more acid groups.

Examples of such polyhydric alcohol having three or more hydroxyl groups may include: sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of polybasic carboxylic acids having three or more functional groups may include polycarboxylic acids and derivatives thereof including: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid, and their anhydrides and lower alkyl esters; and tetracaboxylic acids represented by the formula:

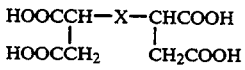

(X denotes a $C_5$ to $C_{30}$-alkylene group or alkenylene group having at least one side chain having at least three carbon atoms), and their anhydrides and lower alkyl esters.

The polyester resin used in the present invention may preferably be constituted from 40–60 mol. %, more preferably 45–55 mol. %, of the alcohol component and 60–40 mol. %, more preferably 55–45 mol. %, of the acid component respectively based on the total of the alcohol and acid components. Further, the total of the polyhydric alcohol and the polybasic acid each having three or more functional Groups may preferably constitute 5–60 mol. % of the total alcohol and acid components constituting the polyester resin.

The metal-containing compound reactive with the resin component in the present invention may be those containing metal ions as follows: monovalent metal ions, such as $Na^+$, $Li^+$, $K^+$, $Cs^+$, $Ag^+$, $Hg^+$ and $Cu^+$; divalent metal ions, such as $Be^{2+}$, $Ba^{2+}$, $Mg^{2+}$, $Ca^{2+}$, $Hg^{2+}$, $Sn^{2+}$, $Pb^{2+}$, $Fe^{2+}$, $Co^{2+}$, $Ni^{2+}$ and $Zn^{2+}$; trivalent ions, such as $Al^{3+}$, $Sc^{3+}$, $Fe^{3+}$, $V^{3+}$, $Co^{3+}$, $Ce^{3+}$, $Ni^{3+}$, $Cr^{3+}$, and $Y^{3+}$, and ions such as $Ti^{4+}$.

Among the above metal compounds, organic metal compounds provide excellent results because they are rich in compatibility with or dispersibility in a polymer and cause a crosslinking reaction uniformly in the polymer or copolymer.

Among the organic metal compounds, organic metal complexes or organic metal salts containing an organic compound, which is rich in vaporizability or sublimability, as a ligand or a counter ion, are advantageously used. Among the organic compounds forming coordinate bonds or ion pairs with metal ions, examples of those having the above property may include: salicylic acid and its derivatives, such as salicylic acid, salicylamide, salicylamine, salicylaldehyde, salicylosalicylic acid, and di-tert-butylsalicylic acid; β-diketones, such as acetylacetone and propionylacetone; low-molecular weight carboxylic acid salts, such as acetate and propionate; hydroxycarboxylic acids, and dicarboxylic acids.

As another type of ligand, it is also preferred to use an azo compound derivative, a heterocyclic compound such as an imidazole derivative or an aromatic compound.

As another compound usable in the present invention in addition to the above-mentioned metal compound, it is also possible to use a compound having two or more functional groups (which may be the same or different) selected from hydroxy group, epoxide group and amino group (in a sense including —NH—). Such a compound may preferably be an aromatic one including a compound wherein aromatic rings having a functional group are bonded to each other with an appropriate bonding group. Examples of such compounds having amino groups for example may include: aliphatic, alicyclic or aromatic amines; aliphatic-aromatic amines; polynuclei-type amines, such as ether-type amines, hydrocarbon-type amines, and fluorene amine; imide-type amines; allsyl ester-type amines; and compounds represented by the following formula (1):

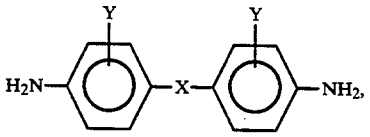

(1)

wherein X denotes a single bond or an arbitrary bonding group, and each Y denotes an arbitrary substituent. Examples of the hydroxyl group-containing compound and the epoxide-containing compound may be obtained by replacing the amino group in the amino group-containing compounds with hydroxy group and epoxide group, respectively.

The binder resin used in the present invention, e.g., in the case of a vinyl-type polymer, may be synthesized in the following manner.

For example, a low-molecular weight polymer is dispersed or dissolved in a polymerizable monomer, and the mixture is polymerized to obtain a resin composition. In this case, it is possible to obtain a resin composition wherein the low-molecular weight polymer and the polymer resulting from the polymerizable monomer are uniformly mixed with each other.

The low-molecular weight polymer in the binder resin composition may be obtained through an ordinary polymerization method, such as bulk polymerization, or solution polymerization.

Examples of the polymer may include homopolymers and copolymers of the above-mentioned vinyl monomers, polyester, polyurethane, epoxy resin, polyamide, polyvinyl butyral, rosin, modified rosin, terpene resin, phenolic resin, aliphatic or alicyclic hydrocarbon resin and aromatic petroleum resin. These resins can also be used as a mixture of two or more species.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization.

The initiator may for example be di-tert-butyl peroxide, tert-butyl peroxybenzoate, benzoyl peroxide, 2,2'-azobisisobutyronitrile or 2,2'-azobis(2,4-dimethylvaleronitrile) and may be used in an amount of at least 0.05 wt. part, preferably 0.1–15. wt. parts, per 100 wt. parts of the monomer (or monomer mixture).

The reaction temperature may depend on the solvent and initiator used and the polymer or copolymer to be produced but may suitably be in the range of 70°–230° C. In the solution polymerization, it is preferred to use 30–400 wt. parts of a monomer (mixture) per 100 wt. parts of the solvent.

The low-molecular weight polymer is again subjected to polymerization together with a monomer (mixture) to provide a high-molecular weight polymer.

In order to produce a crosslinked, high-molecular weight polymer component, the emulsion polymerization or suspension polymerization may preferably be adopted.

Of these, in the emulsion polymerization method, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

On the other hand, in the suspension polymerization method, it is possible to obtain a product resin composition in a uniform state of pearls containing a medium- or high-molecular weight component uniformly mixed with a low-molecular weight component and a crosslinked component by polymerizing a vinyl monomer (mixture) containing a low-molecular weight polymer together with a crosslinking agent in a suspension state.

In the suspension polymerization, a monomer (mixture) containing a low-molecular weight and dispersed in a suspended state may be polymerized together with a crosslinking agent, thus providing a resin composition in the form of uniformly shaped pearls wherein the low-molecular weight polymer and medium- and high-molecular weight polymers are uniformly mixed in a preferable state.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50°–95° C. and selected depending on the polymerization initiator used and the objective polymer. The polymerization initiator should be insoluble or hardly soluble in water, and may be used in an amount of at least 0.05 wt. part, preferably 0.1–15 wt. parts per 100 wt. parts of the vinyl monomer (mixture).

Examples of the initiator may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylonitrile, 2,2'-azobis(2-methylbutyronitrile, 2,2,-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy)hexane, di-t-butyldiperoxyisophthalate, 2,2-bis(4,4-di-t-butylperoxycyclohexyl)-propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di-(t-butylperoxy)hexane, diethylene glycol-bis(t-butylperoxycarbonate), di-t-butylperoxytrimethylazipate, tris(t-butylperoxy)triazine, and vinyl-tris(t-butylperoxy)silane. These initiators may be used singly or in combination.

The binder resin satisfying the above-mentioned molecular weight distribution may also be prepared in the following manner.

A polymer (L) having a main peak in the molecular weight region of $3\times10^3$–$5\times10^4$ and a polymer (H) having a main peak in the molecular weight region of $10^5$ or containing a gel component, are prepared by solution polymerization, bulk polymerization, suspension polymerization, emulsion polymerization, block copolymerization, graft polymerization, etc. These polymers (L) and (H) are subjected to melt kneading, wherein a part or all of the gel component is severed to provide a THF-soluble compound in the molecular weight region of at least $10^5$ measurable by GPC.

Particularly preferred methods may be as follows. The polymers (L) and (H) are separately prepared by solution polymerization and one is added to the solution of the other after the polymerization. One of the polymers is prepared by polymerization in the pressure of the other. The polymer (H) is prepared by suspension polymerization, and the polymer (L) is formed by solution polymerization in the presence of the polymer (H). After the polymerization of the polymer (L) in solution polymerization and, into the solution, the polymer (H) is added. The polymer (H) is formed by suspension polymerization in the presence of the polymer (L). By these methods, it is possible to obtain a polymer mixture including the low-molecular weight component and the high molecular weight component uniformly mixed with each other.

The toner according to the present invention may be provided with desired viscoelastic properties by melt-kneading a binder resin having a certain level of storage modulus because of crosslinking and entanglement of molecular chains under shear for dispersion of other materials and re-crosslinking the resultant resin having severed molecular chains to provide a storage modulus beyond a certain level. The thus obtained crosslinking is also effective in providing an appropriate level of loss modulus, thus providing a good balance of viscoelasticities at high and low temperatures and a good combination of fixability and anti-offset characteristic. It is difficult to obtain such viscoelastic characteristics only through polymerization, thus resulting in contradiction between improvement of fixability and improvement in anti-offset characteristic. It is assumed that the re-crosslinking provides appropriate flexibility and regulation of molecular chains.

Preferred viscoelasticities can be obtained if a resin component with a molecular weight of at least $10^5$ is crosslinked at the time of re-crosslinking. A high-molecular weight compound may be used in order to provide the resultant toner with preferred viscoelasticities but the molecular chains of the component are severed during melt-kneading for sufficient dispersion of the wax and colorant, thus failing to provide objective viscoelasticities. Further, a component with a molecular weight below $10^5$ is effective in improvement of fixability, so that a higher content of the component leads to good fixability. Accordingly, if the high-molecular weight component is increased in compensation for the severed portion thereof in order to obtain desired viscoelasticities, the fixability is impaired. In the present invention, however, the desired viscoelasticities are revived by the re-crosslinking, it is unnecessary to increase the high-molecular weight component. In the present invention, it is also possible to obtain better viscoelasticities than those of the original binder resin, so that the low-molecular weight component can be increased to increase the fixability.

In the case of utilizing an acid component in the binder resin in the present invention, the content of the carboxylic acid, particularly a dicarboxylic acid or its derivative, largely affects the viscoelasticities of the resultant toner. For this reason, the vinyl-type binder resin may preferably show an acid value of 2–100 mgKOH/g, particularly 5–70 mgKOH/g, as measured according to JIS K-0070. If the acid value is below 2 mgKOH/g, it is difficult to obtain desired rubber elasticity at high temperatures. On the other hand, if the acid value exceeds 100 mgKOH/g, it becomes difficult to control the chargeability so that the developing characteristic is liable to be affected by a change in environmental condition.

The toner according to the present invention can further contain a negative or positive charge control agent.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols. Among the above, monoazo metal complexes are preferred.

Examples of the positive charge control agents may include: nigrosine and modified products thereof with aliphatic acid metal salts, etc., onium salts inclusive of quarternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungstic-molybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among these, nigrosine compounds and organic quarternary ammonium salts are particularly preferred.

It is preferred to use the toner according to the present invention together with silica fine powder blended therewith in order to improve the charge stability, developing characteristic and fluidity.

The silica fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide or aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner as a development characteristic improver.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–10 wt. %.

The carrier used for this purpose may be a known one, examples of which may include: powder having magnetism, such as iron powder, ferrite powder, and nickel powder and carriers obtained by coating these powders with a resin, such as a fluorine-containing resin, a vinyl resin or a silicone resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of at most 2 μm, preferably 0.1–0.5 μm, further preferably 0.1–0.3 μm. The magnetic material may preferably show magnetic properties under application of 10 kilo-Oersted, inclusive of: a coercive force of 20–30 Oersted, a saturation magnetization of 50–200 emu/g, and a residual magnetization of 2–20 emu/g. The magnetic material may be contained in the toner in a proportion of 20–200 wt. parts, preferably 40–150 wt. parts, per 100 wt. parts of the resin component.

The toner according to the present invention can contain a colorant which may be an appropriate pigment or dye.

Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the wax, a metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification.

The thus obtained toner may be further blended with other external additives, as desired, sufficiently by means of a mixer such as a Henschel mixer to provide a toner for developing electrostatic images.

Hereinbelow, the present invention will be described more specifically based on Examples.

Preparation of Waxes

First of all, hydrocarbon waxes used in the present invention are described.

Hydrocarbon wax synthesized by the Arge process and subjected to fractional crystallization to obtain wax A (invention), wax B (invention) and wax C (invention).

Wax of a relatively low-molecular weight was obtained by low-pressure polymerization of ethylene using a Ziegler catalyst, and a low-molecular weight component was removed from the wax to some extent by fractional crystallization to obtain wax D (invention). Wax E (comparative) was prepared by thermal decomposition of polyethylene.

Physical properties of these waxes are shown in the following Tables 1 and 2.

TABLE 1

| Molecular weight distribution of waxes | | | | |
|---|---|---|---|---|
| Wax | Mn | Mw | Mw/Mn | Mp |
| A | 780 | 1280 | 1.64 | 1100 |
| B | 910 | 1410 | 1.55 | 1330 |
| C | 610 | 970 | 1.59 | 950 |
| D | 570 | 1170 | 2.05 | 1030 |
| Comparative E | 910 | 5660 | 6.22 | 2700 |

TABLE 2

| Properties of waxes | | | | | |
|---|---|---|---|---|---|
| Wax | Penetration $10^{-1}$ mm | Density g/cm$^3$ | Melt viscosity cP | Softening point °C. | Acid value mgKOH/g |
| A | 0.1 | 0.96 | 14 | 116 | 0.1 |
| B | 0.5 | 0.96 | 18 | 118 | 0.1 |
| C | 0.5 | 0.96 | 10 | 110 | 0.1 |
| D | 1.5 | 0.95 | 12 | 118 | 0.1 |
| Comp. E | 4.5 | 0.93 | 180 | 105 | 0.1 |

Preparation of Binder Resins

SYNTHESIS EXAMPLE 1

| | |
|---|---|
| Styrene | 60.0 wt. part(s) |
| n-Butyl acrylate | 25.0 wt. part(s) |
| Mono-n-butyl maleate | 15.0 wt. part(s) |
| Di-tert-butyl peroxide | 1.5 wt. part(s) |

The above mixture was added dropwise in 4 hours into 200 wt. parts of xylene heated to the reflux temperature. The polymerization was completed under xylene reflux (138°–144° C.), and the xylene was removed by heating up to 200° C. under a reduced pressure to obtain a copolymer.

| | |
|---|---|
| Above copolymer | 30.0 wt. part(s) |
| Styrene | 44.65 wt. part(s) |
| n-Butyl acrylate | 20.0 wt. part(s) |
| Mono-n-butyl maleate | 5.0 wt. part(s) |
| Divinylbenzene | 0.35 wt. part(s) |
| Benzoyl peroxide | 1.3 wt. part(s) |
| Di-tert-butylperoxy-2-ethyl-hexanoate | 0.8 wt. part(s) |

Into the above mixture solution, 170 wt. parts of water containing 0.12 wt. part of partially saponified polyvinyl alcohol dissolved therein was added, and the mixture was stirred vigorously to form a liquid suspension containing suspended particles with a particle size of below 100 μm. Then, into a reaction vessel containing 50 wt. parts of water and aerated with nitrogen, the above liquid suspension was added and subjected to polymerization for 8 hours at 80° C. After the reaction, the polymerizate was recovered by filtration, washed sufficiently with water, dewatered and dried to obtain a styrene-type resin (A), which showed an acid value of 33.2 mgKOH/g.

SYNTHESIS EXAMPLE 2

| | |
|---|---|
| Styrene | 68.0 wt. part(s) |
| n-Butyl acrylate | 22.0 wt. part(s) |
| Mono-n-butyl n-butenyl-succinate | 10.0 wt. part(s) |
| Di-tert-butyl peroxide | 2.0 wt. part(s) |

A copolymer was obtained by solution polymerization of the above ingredients in a similar manner as in Synthesis Example 1.

| | |
|---|---|
| Above copolymer | 30.0 wt. part(s) |
| Styrene | 42.65 wt. part(s) |
| n-Butyl acrylate | 21.0 wt. part(s) |
| Mono-n-butyl n-butenyl-succinate | 6.0 wt. part(s) |
| Divinylbenzene | 0.35 wt. part(s) |
| Benzoyl peroxide | 1.5 wt. part(s) |
| Di-tert-butylperoxy-2-ethyl-hexanoate | 0.5 wt. part(s) |

The above ingredients were subjected to suspension polymerization in a similar manner as in Synthesis Example 1 to obtain resin (B), which showed an acid value of 23.9.

SYNTHESIS EXAMPLE 3

| | |
|---|---|
| Styrene | 75.0 wt. part(s) |
| n-Butyl acrylate | 20.0 wt. part(s) |
| Methacrylic acid | 5.0 wt. part(s) |
| Di-tert-butyl peroxide | 2.0 wt. part(s) |

A copolymer was obtained by solution polymerization of the above ingredients in a similar manner as in Synthesis Example 1.

| | |
|---|---|
| Above copolymer | 30.0 wt. part(s) |
| Styrene | 44.65 wt. part(s) |
| n-Butyl acrylate | 20.0 wt. part(s) |
| Acrylic acid | 5.0 wt. part(s) |
| Divinylbenzene | 0.35 wt. part(s) |

-continued

| | |
|---|---|
| Benzoyl peroxide | 1.0 wt. part(s) |
| Di-tert-butylperoxy-2-ethyl-hexanoate | 0.7 wt. part(s) |

The above ingredients were subjected to suspension polymerization in a similar manner as in Synthesis Example 1 to obtain resin (C), which showed an acid value of 48.7.

SYNTHESIS EXAMPLE 4

| | |
|---|---|
| Styrene | 90 wt. part(s) |
| n-Butyl acrylate | 10 wt. part(s) |
| Di-tert-butyl peroxide | 8 wt. part(s) |

A copolymer was obtained by solution polymerization of the above ingredients in a similar manner as in Synthesis Example 1. The copolymer, as dissolved in THF, provided a GPC chromatogram showing a main peak at a molecular weight of 4500, and showed a Tg (glass transition point) of 60.3° C. The copolymer in 30 wt. parts was dissolved in the following monomer mixture, and the mixture was subjected to suspension polymerization in a similar manner as in Synthesis Example 1 to obtain a styrene-type resin (D) which showed an acid value of 0.8.

| | |
|---|---|
| Styrene | 49.18 wt. part(s) |
| n-Butyl acrylate | 20.5 wt. part(s) |
| Divinylbenzene | 0.32 wt. part(s) |
| Benzoyl peroxide | 1.0 wt. part(s) |
| Di-tert-butylperoxy-2-ethyl-hexanoate | 0.7 wt. part(s) |

SYNTHESIS EXAMPLE 5

| | |
|---|---|
| Styrene | 70.0 wt. part(s) |
| n-Butyl acrylate | 20.0 wt. part(s) |
| Monobutyl maleate | 10.0 wt. part(s) |
| 2,2-Bis(4,4-di-t-butylperoxy-cyclohexyl)propane | 0.3 wt. part(s) |

The above mixture was added dropwise in 4 hours into 200 wt. parts of heated xylene, and the polymerization was completed under xylene refluxing.

| | |
|---|---|
| Styrene | 83.0 wt. part(s) |
| n-Butyl acrylate | 17.0 wt. part(s) |
| Di-tert-butyl peroxide | 1.0 wt. part(s) |

The above mixture was added dropwise in 4 hours into 200 wt. parts of heated xylene and the polymerization was completed under xylene refluxing.

The above two resin solutions were blended with each other in a resin weight ratio of the former 3 to the latter 7, and the solvent was distilled off by heating up to 200° C. under reduced pressure to obtain a resin (E), which showed an acid value of 9.8.

SYNTHESIS EXAMPLE 6

| | |
|---|---|
| Styrene | 82.0 wt. part(s) |
| n-Butyl acrylate | 18.0 wt. part(s) |

-continued

| | |
|---|---|
| Di-t-butyl peroxide | 0.8 wt. part(s) |

The above mixture was added dropwise in 4 hours into 200 wt. parts of heated xylene, and the polymerization was completed under xylene refluxing, followed by distilling-off of the solvent by heating up to 200° C. under reduced. pressure to obtain a resin.

| | |
|---|---|
| Styrene | 75.0 wt. part(s) |
| n-Butyl acrylate | 20.0 wt. part(s) |
| Monobutyl maleate | 5.0 wt. part(s) |
| 1,1-Bis(t-butylperoxide)-3,3,5-trimethylcyclohexane | 0.2 wt. part(s) |

The above mixture was added dropwise in 4 hours into 200 wt. parts of heated xylene and the polymerization was completed under xylene refluxing. Into the resolution containing 4 wt. parts of the resultant resin, 3 wt. parts of the above-prepared resin and 3 wt. parts of a polyester resin (a condensation product among bisphenol A: terephthalic acid: n-dodecenylsuccinic acid: trimellitic acid: diethylene glycol=20:38:10:5:2:7 in mol ratios; Mn=5000, Mw=50000, Tg=59° C., acid value=11.0) were added and sufficiently mixed in solution, followed by distilling-off of the solvent by heating up to 200° C. under reduced pressure to obtain a resin (F), which showed an acid value of 9.7.

SYNTHESIS EXAMPLE 7

| | |
|---|---|
| Styrene | 74.0 wt. part(s) |
| n-Butyl acrylate | 21.0 wt. part(s) |
| Monobutyl maleate | 5.0 wt. part(s) |
| Tris(t-butylperoxy)triazine | 0.4 wt. part(s) |

Into the above mixture solution, 170 wt. parts of water containing 0.12 wt. part of partially saponified polyvinyl alcohol dissolved therein was added, and the mixture was stirred vigorously to form a liquid suspension. Then, into a reaction vessel containing 50 wt. parts of water and aerated with nitrogen, the above liquid suspension was added and subjected to polymerization for 8 hours at 80° C. After the reaction, the polymerizate was recovered by filtration, washed sufficiently with water, dewatered and dried to obtain a polymer in the form of pearls.

| | |
|---|---|
| Styrene | 82.0 wt. parts |
| n-Butyl acrylate | 18.0 wt. parts |
| Di-tert-butyl peroxide | 0.8 wt. part |

The above mixture was added dropwise in 4 hours into 200 wt. parts of heated xylene, and the polymerization was completed under xylene refluxing. Into the solution containing 8 wt. parts of the resultant resin, 2 wt. parts of the above prepared polymer in the form of pearls was added and sufficiently mixed in solution, followed by distilling-off of the solvent by heating up to 200° C. under reduced pressure to obtain a resin (G), which showed an acid value of 6.5.

SYNTHESIS EXAMPLE 8

| | |
|---|---|
| Styrene | 80.0 wt. part(s) |
| n-Butyl acrylate | 20.0 wt. part(s) |

-continued

| | |
|---|---|
| 2,2-Bis(4,4-di-t-butylperoxy-cyclohexyl)propane | 0.3 wt. part(s) |

The above mixture was added dropwise in 4 hours into 200 wt. parts of heated xylene, and the polymerization was completed under xylene refluxing.

| | |
|---|---|
| Styrene | 83.0 wt. part(s) |
| n-Butyl acrylate | 17.0 wt. part(s) |
| Di-tert-butyl peroxide | 1.0 wt. part(s) |

The above mixture was added dropwise in 4 hours into 200 wt. parts of heated xylene and the polymerization was completed under xylene refluxing.

The above two resin solutions were blended with each other in a resin weight ratio of the former 3 to the latter 7, and the solvent was distilled off by heating up to 200° C. under reduced pressure to obtain a resin (H), which showed an acid value of 0.1.

EXAMPLE 1

| | |
|---|---|
| Resin (A) | 100 wt. part(s) |
| Magnetic iron oxide | 80 wt. part(s) |
| 3,5-Di-t-butylsalicylic acid Cr complex | 2 wt. part(s) |
| Wax A | 3 wt. part(s) |

The above ingredients were blended preliminarily and melt-kneaded through a twin-screw kneading extruder equipped with a reverse feed roller in the kneading zone and set at 110° C. The kneaded product was cooled, coarsely crushed, finely pulverized by a pulverizer using jet air and classified by a wind-force classifier to obtain black fine powder (toner 1) having a weight-average particle size of 8 μm.

The viscoelastic characteristics of the toner 1 were measured by using a rheometer ("IR-200", mfd. by Iwamoto Seisakusho K.K. and re-modeled so as to allow measurement by using parallel plates with a plate diameter of 30 mm and a measurement plate gap of about 1 mm) under sine vibration at 200° C. and a frequency of 0.1 Hz. The viscoelasticities at 200° C. and the results of DSC measurement of the toner 1 are shown in Tables 3 and 4 appearing hereinafter.

100 wt. parts of the toner 1 and 0.6 wt. part of hydrophobic colloidal silica were blended to prepare toner 1 having hydrophobic colloidal silica attached to the toner particle surface.

The toner was incorporated in a copying machine ("NP-8582 mfd. by Canon K.K. and remodeled to allow a copying speed of 85 sheets per minute) and subjected to evaluation of image forming characteristic, fixability and anti-offset characteristic.

As a result of a successive copying test of $5\times10^4$ sheets, clear images free from fog were stably formed. The image densities were stably in the range of 1.35–1.39. High-quality images were obtained showing a high resolution, excellent line reproducibility and excellent dot reproducibility.

The images after the successive copying test of $5\times10^4$ sheets were not at all inferior to those obtained at the initial stage. The toner showed substantially no dependence on change in environmental conditions or caused no filming or melt-sticking onto the photosensitive member. No soiling of the fixing roller was observed as a result of the copying.

The anti-blocking characteristic of a toner was evaluated by placing about 20 g of the toner in a 100 cc-plastic cup and the toner in the cup was left standing for 3 days at 50° C. Then, the toner was evaluated by eye observation with respect to its degree of agglomeration.

The fixability, anti-offset characteristic, image-forming characteristic and successive copying characteristic were evaluated in the following manner.

As for the fixability, the testing apparatus was left standing overnight in a low temperature-low humidity environment so as to completely adapt the testing apparatus and the fixing device therein to the low temperature-low humidity environment. Then, 200 sheets of copied images were continuously formed, and the copied image on the 200-th sheet was rubbed with a lens cleaning paper ("Dasper", mfd. by Ozu Paper Co. Ltd.) for 10 reciprocations under a weight of about 100 g. The fixability was evaluated by measuring the degree of peeling of the image in terms of a decrease in reflection density (%).

As for the anti-offset characteristic, the cleaning mechanism was removed from the fixing roller, and the number of successively copied sheets was measured until the images were soiled or the roller was soiled.

In a successive copying operation, the toner once carried by a cleaning web can be re-transferred to the fixing roller thus soiling the copy products. In order to evaluate this reflowing phenomenon, the cleaning mechanism for the fixing roller was restored into the original position, and the fixing operation was performed at a temperature which was made higher by 5° C. from the ordinary setting temperature. After successive copying of 200 sheets, copied images were intermittently formed with an interval of 30 sec for each sheet up to 3 minutes, whereby the occurrence of image soiling was observed and the state of soiling of the fixing roller cleaning web.

As a result of the above evaluation, the toner 1 showed no agglomerates observable with eyes with respect to the anti-blocking characteristic. The toner 1 showed a density decrease of 9% with respect to the fixability and caused no offset. Further, no toner reflowing from the fixing roller cleaning member was observed. No damage on the fixing roller was observed after the successive copying.

EXAMPLE 2

| | |
|---|---|
| Resin (B) | 100 wt. part(s) |
| Magnetic iron oxide | 60 wt. part(s) |
| Monoazo Cr complex | 1 wt. part(s) |
| Acetylacetone Al complex | 1 wt. part(s) |
| Wax B | 3 wt. part(s) |

Toner 2 having a weight-average particle size of 12 μm was prepared from the above ingredients otherwise in a similar manner as in Example 1. The viscoelasticities and DSC characteristics of the toner 2 are shown in Tables 3 and 4.

100 wt. parts of the toner 2 was blended with 0.4 wt. part of hydrophobic colloidal silica.

The result toner was evaluated in the same manner as in Example 1, and the results thereof are shown in Table 5 appearing hereinafter.

EXAMPLE 3

| | |
|---|---|
| Resin (C) | 100 wt. part(s) |
| Magnetic iron oxide | 80 wt. part(s) |
| t-Butylphthalic acid Cr complex | 2 wt. part(s) |
| Wax C | 3 wt. part(s) |

Toner 3 having a weight-average particle size of 8 μm was prepared from the above ingredients otherwise in a similar manner as in Example 1. The viscoelasticities and DSC characteristics of the toner 3 are shown in Tables 3 and 4.

100 wt. parts of the toner 3 was blended with 0.6 wt. part of hydrophobic colloidal silica.

The result toner was evaluated in the same manner as in Example 1, and the results thereof are shown in Table 5 appearing hereinafter.

COMPARATIVE EXAMPLE 1

| | |
|---|---|
| Resin (D) | 100 wt. part(s) |
| Magnetic iron oxide | 80 wt. part(s) |
| 3,5-Di-t-butylsalicylic acid Cr complex | 2 wt. part(s) |
| Wax A | 3 wt. part(s) |

Toner 4 having a weight-average particle size of 8 μm was prepared from the above ingredients otherwise in a similar manner as in Example 1. The viscoelasticities and DSC characteristics of the toner 4 are shown in Tables 3 and 4.

100 wt. parts of the toner 4 was blended with 0.6 wt. part of hydrophobic colloidal silica.

The result toner was evaluated in the same manner as in Example 1, and the results thereof are shown in Table 5 appearing hereinafter. As the re-crosslinking was not effectively caused, the toner failed to show a sufficient storage modulus at high temperatures, thus showing an inferior anti-offset characteristic than Example 1.

EXAMPLE 4

| | |
|---|---|
| Resin (B) | 100 wt. part(s) |
| Magnetic iron oxide | 80 wt. part(s) |
| Wax A | 4 wt. part(s) |
| Nigrosine | 2 wt. part(s) |
| 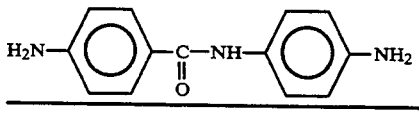 | 0.5 wt. part(s) |

Toner 5 having a weight-average particle size of 8 μm was prepared from the above ingredients otherwise in a similar manner as in Example 1. The viscoelasticities and DSC characteristics of the toner 5 are shown in Tables 3 and 4.

100 wt. parts of the toner 5 was blended with 0.6 wt. part of hydrophobic colloidal silica.

The resultant toner was incorporated in a copying machine ("NP-8580", mfd. by Canon K.K. and remodeled to be equipped with a negatively chargeable amorphous silicon drum and allow for use of a positively chargeable toner) and evaluated with respect to fixability, anti-toner reflowing characteristic, image-forming characteristic and successive copying characteristic in similar manners as in Example 1. The results of evaluation are shown in Table 6. Throughout the copying test, images having high densities (1.34–1.38) and free from fog were stably obtained. The images were excellent in dot reproducibility and line reproducibility and faithful to the original image. The fixability was good and no offset was caused. Further, no reflowing from the fixing roller cleaning member was observed.

EXAMPLE 5

| | |
|---|---|
| Resin (F) | 100 wt. part(s) |
| Magnetic iron oxide | 80 wt. part(s) |
| Wax D | 4 wt. part(s) |
| 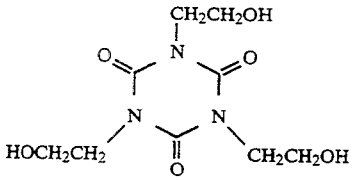 | 0.5 wt. part(s) |
| Triphenylmethane | 2 wt. part(s) |

Toner 6 having a weight-average particle size of 8 μm was prepared from the above ingredients otherwise in a similar manner as in Example 1. The viscoelasticities and DSC characteristics of the toner 6 are shown in Tables 3 and 4. The toner 6 was blended with hydrophobic colloidal silica similar as in Example 4.

The result toner was evaluated in the same manner as in Example 4, and the results thereof are shown in Table 6 appearing hereinafter.

EXAMPLE 6

| | |
|---|---|
| Resin (G) | 100 wt. part(s) |
| Magnetic iron oxide | 80 wt. part(s) |
| Wax B | 4 wt. part(s) |
| 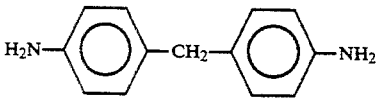 | 0.5 wt. part(s) |
| Nigrosine | 2 wt. part(s) |

Toner 7 having a weight-average particle size of 8 μm was prepared from the above ingredients otherwise in a similar manner as in Example 1. The viscoelasticities and DSC characteristics of the toner 7 are shown in Tables 3 and 4. The toner 2 was blended with hydrophobic colloidal silica similarly as in Example 4.

The result toner was evaluated in the same manner as in Example 4, and the results thereof are shown in Table 6 appearing hereinafter.

COMPARATIVE EXAMPLE 2

| | |
|---|---|
| Resin (G) | 100 wt. part(s) |
| Magnetic iron oxide | 80 wt. part(s) |
| Wax B | 4 wt. part(s) |
| Nigrosine | 2 wt. part(s) |

Toner 8 having a weight-average particle size of 8 μm was prepared from the above ingredients otherwise in a similar manner as in Example 1. The viscoelasticities and DSC characteristics of the toner 8 are shown in Tables 3 and 4. The toner 8 was blended with hydrophobic colloidal silica similarly as in Example 4.

The result toner was evaluated in the same manner as in Example 4, and the results thereof are shown in Table 6 appearing hereinafter.

In short, the toner 8 showed good image-forming characteristic but showed inferior toner flowing-preventing characteristic.

COMPARATIVE EXAMPLE 3

| | |
|---|---|
| Resin (G) | 100 wt. part(s) |
| Magnetic iron oxide | 80 wt. part(s) |
| Wax E | 4 wt. part(s) |
| 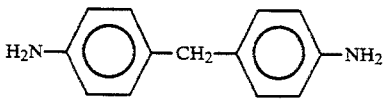 | 0.5 wt. part(s) |
| Nigrosine | 2 wt. part(s) |

Toner 9 having a weight-average particle size of 8 μm was prepared from the above ingredients otherwise in a similar manner as in Example 1. The viscoelasticities and DSC characteristics of the toner 9 are shown in Tables 3 and 4. The toner 9 was blended with hydrophobic colloidal silica similarly as in Example 4.

The result toner was evaluated in the same manner as in Example 4, and the results thereof are shown in Table 6 appearing hereinafter.

In short, the toner 9 showed good image-forming characteristic but showed inferior fixability.

COMPARATIVE EXAMPLE 4

| | |
|---|---|
| Resin (H) | 100 wt. part(s) |
| Magnetic iron oxide | 80 wt. part(s) |
| 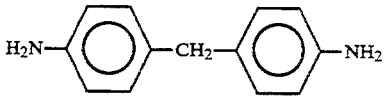 | 0.5 wt. part(s) |
| Nigrosine | 2 wt. part(s) |

Toner 10 having a weight-average particle size of 8 μm was prepared from the above ingredients otherwise in a similar manner as in Example 1. The viscoelasticities and DSC characteristics of the toner 10 are shown in Tables 3 and 4. The toner 10 was blended with hydrophobic colloidal silica similarly as in Example 4.

The result toner was evaluated in the same manner as in Example 4, and the results thereof are shown in Table 6 appearing hereinafter.

In short, the toner 10 showed clearly inferior fixability, anti-offset characteristic and toner flow-preventing characteristic.

Incidentally, the toner 10 provided a DSC curve also showing a peak which was attributable to glass transition of the binder resin and also observable with respect to the other toners.

TABLE 3

| | Viscoelastic characteristic at 200° C., 0.1 Hz | | |
|---|---|---|---|
| Toner | Storage modulus (G') (dyn/cm$^2$) | Loss modulus (G'') (dyn/cm$^2$) | Loss tangent (G''/G') |
| 1 | $6.5 \times 10^3$ | $4.1 \times 10^3$ | 0.63 |

TABLE 3-continued

| Toner | Viscoelastic characteristic at 200° C., 0.1 Hz: Storage modulus (G') (dyn/cm²) | Loss modulus (G'') (dyn/cm²) | Loss tangent (G''/G') |
|---|---|---|---|
| 2 | $9.6 \times 10^3$ | $3.8 \times 10^3$ | 0.40 |
| 3 | $2.0 \times 10^3$ | $6.6 \times 10^3$ | 0.33 |
| 4** | $2.8 \times 10^3$ | $3.4 \times 10^3$ | 1.21 |
| 5 | $4.8 \times 10^3$ | $3.4 \times 10^3$ | 0.71 |
| 6 | $6.7 \times 10^3$ | $4.4 \times 10^3$ | 0.66 |
| 7 | $4.7 \times 10^3$ | $2.1 \times 10^3$ | 0.45 |
| 8** | $1.8 \times 10^3$ | $2.2 \times 10^3$ | 1.22 |
| 9** | $4.5 \times 10^3$ | $2.2 \times 10^3$ | 0.49 |
| 10** | $2.9 \times 10^3$ | $3.3 \times 10^3$ | 1.14 |

**Toners 4, 8, 9 and 10 are those of comparative examples.

TABLE 4

| Toner | Wax | DSC characteristics of toner: On heating: TLP °C. | Tonset °C. | Tpeak °C. | On cooling: Tpeak °C. | ΔH/ΔT × $10^{-3}$ |
|---|---|---|---|---|---|---|
| 1 | A | 88 | 98 | 105 | 69 | 24.8 |
| 2 | B | 91 | 99 | 110 | 70 | 25.5 |
| 3 | C | 86 | 94 | 99 | 67 | 26.3 |
| 4** | A | 87 | 98 | 106 | 69 | 23.7 |
| 5 | A | 88 | 97 | 105 | 70 | 32.2 |
| 6 | D | 83 | 101 | 115 | 67 | 13.6 |
| 7 | B | 90 | 100 | 109 | 71 | 31.9 |
| 8** | B | 91 | 99 | 111 | 70 | 32.6 |
| 9** | E | 72 | 80 | 99 | 63 | 1.49 |
| 10** | none | 47 | 56 | 64 | — | — |

TLP: Rising initiation temperature
Tonset: Onset temperature
Tpeak: Peak temperature (on heating and on cooling)
ΔH/ΔT: Peak intensity ratio
**Toners 4, 8, 9 and 10 are those of comparative examples tics because of specific viscoelastic characteristics based on performances of a binder resin and the sue of a specific hydrocarbon wax allowing to promote the performances of the binder resin. More specifically, the toner according to the present invention can show the following properties:

(1) Excellent in low-temperature fixability and anti-offset characteristic.
(2) Excellent in anti-offset characteristic at high temperatures.
(3) Excellent in anti-blocking characteristic and free from deterioration in developing performance even when left standing for a long period.
(4) Excellent in durability against elevation in temperature of an apparatus body, such as that of a copying machine or a printer.
(5) Capable of satisfying the above properties without contradiction.

What is claimed is:

1. A toner for developing an electrostatic image, comprising: a binder resin and a hydrocarbon wax having a weight-average molecular weight of 800 to 3600, wherein the toner shows a storage modulus of at least $1 \times 10^3$ dyn/cm², a loss modulus in the range of $5 \times 10^2$–$5 \times 10^4$ dyn/cm² and a ratio of loss modulus/storage modulus (loss tangent) of below 0.9 as measured under conditions of a frequency of 0.1 Hz and a temperature of 200° C.; and the toner provides a DSC curve, as measured by a differential scanning calorimeter, showing an onset temperature of heat absorption of at most 105° C. and a heat-absorption peak temperature in the range of 90°–120° C. on temperature increase, and a heat evolution peak temperature in the range of 62°–75° C. and a heat evolution peak intensity ratio of at least $5 \times 10^{-3}$ on temperature decrease.

TABLE 5

| Example | Toner | Evaluation of toner performances (1): Anti-blocking | Fixability | Anti-offset | Soiling from cleaning member: Soiling of cleaning member | Image soiling | Image quality | Soiling of fixing roller after the test |
|---|---|---|---|---|---|---|---|---|
| Ex. | | | | | | | | |
| 1 | 1 | ◎ | 9% | ◎ | ◎ | ◎ | ◎ | ◎ |
| 2 | 2 | ◎ | 8% | ◎ | ◎ | ◎ | ○ | ◎ |
| 3 | 3 | ○ | 5% | ◎ | ◎ | ○ | ◎ | ◎ |
| Comp. Ex. | | | | | | | | |
| 1 | 4 | ◎ | 11% | ○ | ○ | Δ | ◎ | Δ |

◎: Excellent
○: Good
Δ: Fair
X: Not acceptable

TABLE 6

| Example | Toner | Evaluation of toner performances (2): Anti-blocking | Fixability | Anti-offset | Soiling from cleaning member: Soiling of cleaning member | Image soiling | Image quality | Soiling of fixing roller after the test |
|---|---|---|---|---|---|---|---|---|
| Ex. | | | | | | | | |
| 4 | 5 | ◎ | 7% | ◎ | ◎ | ◎ | ◎ | ◎ |
| 5 | 6 | ○ | 11% | ◎ | ◎ | ○ | ◎ | ◎ |
| 6 | 7 | ◎ | 9% | ◎ | ◎ | ◎ | ◎ | ◎ |
| Comp. Ex. | | | | | | | | |
| 2 | 8 | ◎ | 8% | ○ | Δ | Δ | ◎ | ○ |
| 3 | 9 | Δ | 14% | ○ | ○ | Δ | ◎ | ○ |
| 4 | 10 | ◎ | 18% | Δ | Δ | X | ◎ | X |

◎: Excellent
○: Good
Δ: Fair
X: Not acceptable

As is clear from the results of the above Examples and Comparative Examples, the toner according to the present invention is provided with desired characteris- 2. A toner according to claim 1, wherein the toner shows a storage modulus of $2\times10^3$–$5\times10^4$ dyn/cm$^2$.

3. A toner according to claim 1, wherein the toner shows a storage modulus of $3\times10^3$–$2\times10^4$ dyn/cm$^2$.

4. A toner according to claim 1, wherein the toner shows a loss modulus of $1\times10^3$–$2\times10^4$ dyn/cm$^2$.

5. A toner according to claim 1, wherein the toner provides a DSC curve including a heat absorption peak showing a rising initiation temperature of at least 80° C.

6. A toner according to claim 1, wherein the toner provides a DSC curve showing an onset temperature of heat absorption of 90°–120° C.

7. A toner according to claim 1, wherein the toner provides a DSC curve showing a heat absorption peak temperature of 100°–115° C.

8. A toner according to claim 1, wherein the toner provides a DSC curve showing a heat evolution peak temperature of 65°–72° C.

9. A toner according to claim 1, wherein the toner provides a DSC curve showing a maximum heat evolution peak in a temperature region of 62°–75° C.

10. A toner according to claim 1 wherein the binder resin has an acid value of 5–70 mgKOH/g.

11. A toner according to claim 1, wherein the toner provides a DSC curve showing a heat evolution peak intensity ratio of at least $10\times10^3$.

12. A toner according to claim 1, wherein the hydrocarbon wax has a weight-average molecular weight of 900–3000.

13. A toner according to claim 1, wherein the hydrocarbon wax has a number-average molecular weight of 550–1200.

14. A toner according to claim 1, wherein the hydrocarbon wax has a number-average molecular weight of 600–1000.

15. A toner according to claim 1, wherein the hydrocarbon wax has a ratio of weight average molecular weight (Mw)/number-average molecular weight (Mn) of at most 3.

16. A toner according to claim 15, wherein the hydrocarbon wax has an Mw/Mn ratio of at most 2.5.

17. A toner according to claim 15, wherein the hydrocarbon wax has an Mw/Mn ratio of at most 2.0.

18. A toner according to claim 1, wherein the hydrocarbon wax provides a molecular weight distribution by GPC showing a peak in a molecular weight region of 700–2400.

19. A toner according to claim i, wherein the hydrocarbon wax provides a molecular weight distribution by GPC showing a peak in a molecular weight region of 750–2000.

20. A toner according to claim 1, wherein the hydrocarbon wax provides a molecular weight distribution by GPC showing a peak in a molecular weight region of 800–1600.

21. A toner according to claim 1, wherein the hydrocarbon wax has a density of at least 0.95 g/cm$^3$ at 25° C.

22. A toner according to claim 1, wherein the hydrocarbon wax has a penetration of at most 1.5 ($\times10^{-1}$ mm).

23. A toner according to claim 1, wherein the hydrocarbon wax has a penetration of at most 1.0 ($\times10^{-1}$ mm).

24. A toner according to claim 1, wherein the hydrocarbon wax shows a melt viscosity at 140° C. of at most 100 cP.

25. A toner according to claim 1, wherein the hydrocarbon wax shows a melt viscosity at 140° C. of at most 50 cP.

26. A toner according to claim 1, wherein the hydrocarbon wax shows a melt viscosity at 140° C. of at most 20 cP.

27. A toner according to claim 1, wherein the hydrocarbon wax has an acid value of below 2.0 mgKOH/g.

28. A toner according to claim 1, wherein the hydrocarbon wax has an acid value of below 1.0 mgKOH/g.

29. A toner according to claim 1, wherein the hydrocarbon wax is contained in a proportion of at most 20 wt. parts per 100 wt. parts of the binder resin.

30. A toner according to claim 1, wherein the hydrocarbon wax is contained in a proportion of 0.5–10 wt. parts per 100 wt. parts of the binder resin.

31. A toner according to claim 1, wherein all or a part of the binder resin has a functional group.

32. A toner according to claim 31, wherein the functional group is selected from the class consisting of carboxyl group, acid anhydride group, ester group easily susceptible of transesterification, hydroxy group, amino group, glycidyl group, epoxide group, active methylene group, double bond-containing group, cyano group, and isocyanate group.

33. A toner according to claim 1, wherein the binder resin has an acid value of 2–100, mgKOH/g.

* * * * *

UNITED STATES PATENT AND TRADEMARK OFFICE

CERTIFICATE OF CORRECTION

PATENT NO. : 5,384,224

DATED : January 24, 1995

INVENTOR(S) : HIROHIDE TANIKAWA, ET AL.

It is certified that error appears in the above-identified patent and that said Letters Patent is hereby corrected as shown below:

ON TITLE PAGE

In [75] Inventors: "masashi Jinbo" should read --Masashi Jinbo--.

In [57] ABSTRACT, Line 7: "$1\times10^{3}$ dyn/cm2," should read --$1\times10^{3}$dyn/cm$^{2}$,--.

COLUMN 1

Line 9, "electrophotography" should read --electrophotographic--.

COLUMN 7

Line 25, ".is" should read --is--.

COLUMN 8

Line 45, "group" should read --groups--.

COLUMN 11

Line 6, "$\leftarrow OR'\rightarrow_{x}$" shoudl read -- $\leftarrow OR'\rightarrow_{x'}$ -- and "$\leftarrow R'-O\rightarrow_{y}$" should read -- $\leftarrow R'-O\rightarrow_{y'}$ --.
Line 34, "alcohol" should read --alcohols--.

COLUMN 12

Line 1, "Groups" should read --groups--.
Line 11, "ions" should read --tetravalent ions,--.
Line 49, "allsyl" should read --allyl--.

UNITED STATES PATENT AND TRADEMARK OFFICE

CERTIFICATE OF CORRECTION

PATENT NO. : 5,384,224

DATED : January 24, 1995

INVENTOR(S) : HIROHIDE TANIKAWA, ET AL.

It is certified that error appears in the above-identified patent and that said Letters Patent is hereby corrected as shown below:

COLUMN 13

Line 66, "constitute" should read --constitutes--.

COLUMN 16

Line 24, "complexes" should read --complexes,--.
Line 36, "quarternary" should read --quaternary--.
Line 50, "quarternary" should read --quaternary--.

COLUMN 25

Line 52, "toner 2" should read --toner 7--.

COLUMN 28

Line 2, "sue" should read --use--.

COLUMN 29

Line 22, "claim 1" should read --claim 1,--.
Line 26, "$10\times10^{3}$." should read --$10\times10^{-3}$.--.
Line 37, "weight average" should read --weight-average--.

UNITED STATES PATENT AND TRADEMARK OFFICE

CERTIFICATE OF CORRECTION

PATENT NO. : 5,384,224

DATED : January 24, 1995

INVENTOR(S) : HIROHIDE TANIKAWA, ET AL.

It is certified that error appears in the above-identified patent and that said Letters Patent is hereby corrected as shown below:

COLUMN 30

Line 1, "claim i," should read --claim 1,--.
Line 46, "2-100," should read --2-100--.

Signed and Sealed this

Twenty-third Day of May, 1995

*Attest:*

BRUCE LEHMAN

*Attesting Officer*

*Commissioner of Patents and Trademarks*